United States Patent [19]

Jang

[11] Patent Number: 4,950,193

[45] Date of Patent: Aug. 21, 1990

[54] MANUFACTURING METHOD FOR FLUORESCENT INDICATOR PANEL

[75] Inventor: Chul-Hyun Jang, Seoul, Rep. of Korea

[73] Assignee: Samsung Electron Devices Co., Ltd., Rep. of Korea

[21] Appl. No.: 425,917

[22] Filed: Oct. 24, 1989

[30] Foreign Application Priority Data

Oct. 27, 1988 [KR] Rep. of Korea ..... 88-14029

[51] Int. Cl.[5] ..... H01J 9/36

[52] U.S. Cl. ..... 445/24; 445/29

[58] Field of Search ..... 445/24, 25, 32, 29

[56] References Cited

U.S. PATENT DOCUMENTS 4,263,700 4/1981 Fujisaki et al. ..... 425/25

*Primary Examiner*—Kenneth J. Ramsey

*Attorney, Agent, or Firm*—Leydig, Voit & Mayer

[57] ABSTRACT

A manufacturing method for a fluorescent indicator panel is disclosed which is characterized in that, in the step of forming an insulative layer, electrode plates are attached at the places where metal components are to be attached, then a conductive layer and a fluorescent layer are formed, and then, the metal components are attached upon the electrode plates. According to the method of the present invention, the fluorescent layer does not undergo the decrease of the luminance due to the contamination of harmful gases or the thermal degradation, while, owing to the omission of the troublesome and unproductive frit baking process, the fabrication is rendered easier, the productivity is improved, and the aesthetical appearance is also upgraded due to the removal of the frit spread portion.

3 Claims, 1 Drawing Sheet

MANUFACTURING METHOD FOR FLUORESCENT INDICATOR PANEL

FIELD OF THE INVENTION

The present invention relates to a manufacturing method for a fluorescent indicator panel.

BACKGROUND OF THE INVENTION

Generally a fluorescent indicator panel used as a digital indicator for expressing characters or symbols in a digital form in electronic meters and calculators has the constitution as illustrated in FIG. 1.

Wiring layers 12 such as connection terminal pattern 12*a* and an inner connection pattern 12*b*, an insulative layer 13, and a conductive layer 14 forming a anode segment of a required pattern are sequentially deposited upon an insulative base board 11 through a printing method and the like, thus the base board 11 constituting a printed board.

Meanwhile, the base board 11 is usually made of a ceramic material or a glass material, and therefore, the wiring layer 12, the insulative layer 13 and the conductive layer 14 which are printed on the base board 11 are first coated with a paint or paste containing silicic acid ingredient such as kasil ($K_2SiO_3$) or crystalline glass powder (to be called hereinafter "frit"), thereafter the layers 12,13,14 being baked so as for them to be united with the base board 11.

A fluorescent material is spread on the conductive layer 14 of the printed board formed by the above described method, thereby forming a fluorescent layer 15. Above the fluorescent layer 15, a metal component, i.e. a grid 16 or a support (not shown) for supporting a filament 17 is disposed, and then, an envelope 18 is attached sealingly to the printed board for covering all of the above described components, thereby completing the manufacturing of a fluorescent indicator panel.

In the conventional manufacturing method of the fluorescent indicator panel described above, the metal component such as a grid 16 or a support for supporting the filament 17 is, for example, attached to the printed board by securing the related parts by means of the frit which is cited as a prior art in Japanese Utility Model Publication No. Sho 56-20932.

However, the above mentioned frit F essentially requires a high temperature baking under 450°~500° C. in order to crystallize it, and therefore, there arises the problem that a baking process has to be added in attaching the grid 16. Further, the organic binder and the like contained in the frit F can be decomposed at the high temperature to generate harmful gases, and these gases are absorbed into the already formed fluorescent layer 15, thereby deteriorating the luminance of the fluorescent layer 15. Particularly, if the red fluorescent material which is low in the thermal stability is subjected to heating up to the baking temperature, the luminance is drastically lowered, thereby making it difficult to use it in the fluorescent indicator panel.

Further, until the crystallization is achieved after the baking process, the semi-fluidal frit supports the metal components such as the grid 16, and therefore, its exact positioning is very difficult, with the result that the precision of the fluorescent indicator panel is lowered. Further, the baking process which is carried out at the time of attaching the metal components in order to maintain the precision is much more fastidious compared with the baking process which is carried out at the time of forming the printed board, and therefore, the product rejection rate is increased, thereby aggravating the productivity.

Further, the above mentioned baking process is carried out under an oxidizing atmosphere, and therefore, there is accompanied the problem that the grid 16 is oxidized, and its efficiency is lowered.

SUMMARY OF THE INVENTION

The present invention is intended to overcome the various problems encountered in the conventional methods.

Therefore, it is the object of the present invention to provide a manufacturing method for a fluorescent indicator panel, in which the lowering of the luminance of the fluorescent layer and the oxidation of the metal components do not occur, the process is shortened, the workability is improved, the process is not limited by the thermal characteristics of the fluorescent material, and the precision of the panel is improved.

To accomplish the above object, the manufacturing method for the fluorescent indicator panel according to the present invention comprises steps of forming a wiring layer, an insulative layer, a conductive layer, and a fluorescent layer upon an insulative base board, and attaching metal components thereupon, characterized in that, during the step of forming the insulative layer, an electrode plate is attached at the place where the metal component is to be attached, then the conductive layer and the fluorescent layer are formed, and the metal components are attached on the electrode plate.

According to the manufacturing method of the present invention, the problems of the harmful contaminations or thermal degradations in the formation of the fluorescent layer and in attaching the metal components can be avoided. Further, the baking process and the frit coating which are troublesome and difficult in controlling the precision are omitted, and therefore, the production is rendered easier.

BRIEF DESCRIPTION OF THE DRAWINGS

The above object and other advantages of the present invention will become more apparent by describing the preferred embodiment of the present invention with reference to the attached drawings in which.

DESCRIPTION OF THE PREFERRED EMBODIMENT

Figure 1:
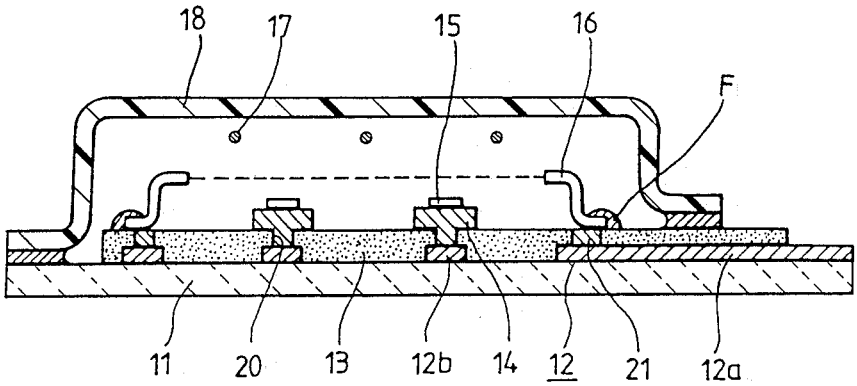
FIG. 1 is a sectional view showing a conventional fluorescent indicator panel.
Figure 2:
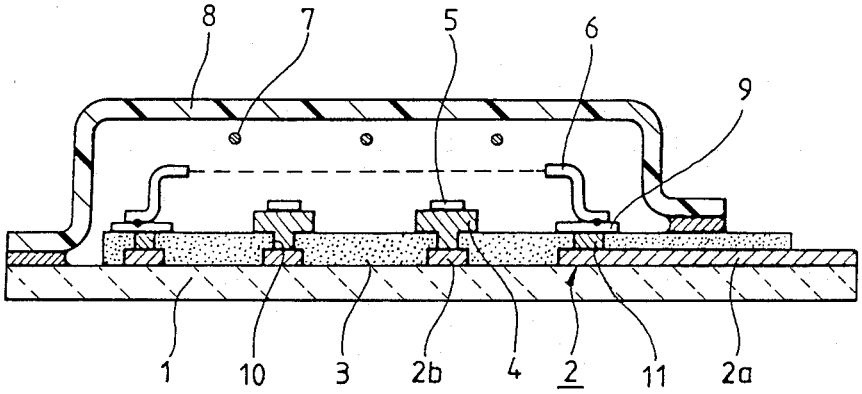
FIG. 2 is a sectional view showing the fluorescent indicator panel manufactured according to the method of the present invention.

The fluorescent indicator panel illustrated in FIG. 2 is manufactured based on the sequence as described below according to the present invention.

Upon a base board 1 made of an insulative material such as ceramic or glass, a conductive paste containing a conductive ingredient such as silver is deposited preferably by a printing method in the required pattern, and the resultant product is baked, for example, at a temperature of 550° C. to 600° C. for about an hour, thereby forming a wiring layer 2 including a connection terminal pattern 2*a* and an inner connection pattern 2*b*.

Then, the upper face of the inner connection pattern 2*b* of the wiring layer 2 is coated with an insulative glass coating material containing the frit and the like as the principal ingredient, and if required, also containing pigment of a proper color such as black, the coating being carried out by a printing method and the like, and the coating being excluded at the places where connecting holes 10 for electrical connections are to be formed.

After the glass coating material is properly dried, the places where metal components such as supports for supporting a grid 6 and a filament 7 are to be attached are applied with conductive adhesive 11 containing as the principal ingredient conductive material such as graphite and the like, and then, electrode plates 9 are put upon the places. Then, the electrode plates 9 are be secured, and a part of the adhesive 11 will flow into the connecting holes 10, so that the inner connection pattern **2*b* of the wiring layer 2 and the electrode plates 9 become electrically connected. The electrode plates 9 are made of a conductive thin metal sheet, and preferably are made of an alloy such as 426 alloy which is similar in its thermal expansion coefficient to the material of the base board 1** (ceramic or glass).

The printed board on which the electrode plates 9 are attached is baked, for example, at a temperature of 550° C. for an hour so as for the insulative glass coating material to be melted, and when the coating material is cools down, a glass insulative layer 3 formed, and the electrode plates 9 are integrally secured. A coating material containing a conductive ingredient such as graphite is deposited around the connecting hole 10 by a printing method and the like according to the letters or symbols to be expressed, and then, a baking is carried out to form a conductive layer 4 constituting a anode segment which is electrically connected through the connecting hole 10 to the inner connection pattern **2*b* of the wiring layer 2**.

Upon the conductive layer 4, a fluorescent material in the state of paste is spread, and then, a baking process is carried out to form a fluorescent layer 5.

Then metal components such as grid 6 and supports for supporting the filament 7 are installed by mounting the metal components on the electrode plates 9, and they are attached preferably by spot welding and the like.

Then the finishing processes such as the installations of the filament 7 and a getter, the sealingly attaching of an envelope 8, and the getter flashing are carried out, thereby completing the manufacturing of the fluorescent indicator panel.

The manufacturing method for the fluorescent indicator panel according to the present invention constituted as above will now be described as to its effects.

According to the method of the present invention as described above, the metal components such as the grid or the supports for supporting the filament are not attached by spreading of the frit and by carrying out a baking process in separate step, but they are attached to the electrode plates which are integrally secured with the insulative layer during the baking of the layer, with the result that the fluorescent layer does not undergo the contamination of a harmful gas or the decrease of the luminance due to the thermal degradation, and that a fluorescent material having a low thermal stability such as a red fluorescent material can be used without restriction. Further, there occurs no decrease of the efficiency due to the oxidation of the grid and the like, and the metal components can be installed at the exact positions, thereby making it possible to produce a fluorescent indicator panel having a high luminance and a high precision.

Further, owing to the omission of the troublesome and unproductive frit baking process, the fabrication is rendered easier, the productivity is improved, and the aesthetic appearance is also upgraded due to the removal of the frit spread portion.

What is claimed is:

1. A manufacturing method for a fluorescent indicator panel having: steps of forming a wiring layer, an insulative layer, a conductive layer and a fluorescent layer upon a base board, and attaching metal components thereupon, wherein, in the step of forming said insulative layer, electrode plates are attached at the places where said metal components are to be attached, then said conductive layer and said fluorescent layer are formed, and then, said metal components are attached on said electrode plates.

2. The manufacturing method for a fluorescent indicator panel as claimed in claim 1, wherein the attachment method for said electrode plates is carried out during the insulative layer forming step in such a manner that, after spreading of an insulative coating material for forming said insulative layer, said electrode plates are mounted thereupon, and a baking is carried out, thereby integrally securing said electrode plates to said insulative layer.

3. The manufacturing method for a fluorescent indicator panel as claimed in claim 1, wherein said metal components are attached on said electrode plates by a spot welding.

* * * * *